US005743282A

United States Patent [19]

Pellerin

[11] Patent Number: 5,743,282

[45] Date of Patent: Apr. 28, 1998

[54] RECUPERATION BASIN

[76] Inventor: Michel Pellerin, 2483 Junction Ave., Ottawa, Ontario, Canada, K1V 8J9

[21] Appl. No.: 512,199

[22] Filed: Aug. 7, 1995

[51] Int. Cl.[6] ..... B08B 3/04

[52] U.S. Cl. ..... 134/117; 134/201; 134/169 A; 134/186; 134/135

[58] Field of Search ..... 4/625; 134/900, 134/901, 104.2, 117, 118, 201, 135, 88, 91, 92, 109, 111, 169 A, 85, 115 R, 176, 185

[56] References Cited

U.S. PATENT DOCUMENTS

| | | | |
|---|---|---|---|
| 1,234,305 | 7/1917 | Dolter | 134/118 |
| 2,664,854 | 1/1954 | Talbot | 134/135 |
| 3,280,828 | 10/1966 | Stiel | 134/135 |
| 3,453,665 | 7/1969 | Cokic et al. . | |
| 3,834,409 | 9/1974 | Kuparinen | 135/135 X |
| 4,012,798 | 3/1977 | Liautaud . | |
| 4,444,307 | 4/1984 | Jermyn | 134/901 |
| 4,462,415 | 7/1984 | Otzen . | |
| 5,277,209 | 1/1994 | Olson | 134/201 |

FOREIGN PATENT DOCUMENTS

| | | | |
|---|---|---|---|
| 769838 | 10/1967 | Canada . | |
| 419713 | 11/1934 | United Kingdom | 4/625 |

*Primary Examiner*—Frankie L. Stinson
*Attorney, Agent, or Firm*—Kent & Edgar

[57] ABSTRACT

The present invention provide for a recuperation basin. The basin comprises a basin section having a bottom and circumscribing walls, and an adjacent liquid storage container having walls circumscribing a central chamber. One of the walls of the basin and one of the walls of the container intermediate the two form a common wall. An aperture is located in the common wall so as to permit passage of liquid in the container chamber into the basin and to permit passage of liquid from the basin into the container chamber by tilting the recuperation basin so the basin is somewhat above the container chamber.

10 Claims, 2 Drawing Sheets

RECUPERATION BASIN

FIELD OF THE INVENTION

The present invention relates to a recuperation basin, and more particularly to a combination basin and liquid container which readily permits filling of the basin with liquid from the container, for use of the liquid, and then return of the liquid from the basin to the container for storage when not in use.

BACKGROUND OF THE INVENTION

Wash basins specifically adapted to the cleaning of parts or paint applicators and the like with solvent are well-known. Solvent is poured from a solvent container into the basin and, once the solvent has been used to clean the parts, brushes or the like, the used solvent is stored in a separate container for future use or disposal, or otherwise disposed of. Since many such solvents are considered to be hazardous wastes or at least environmentally unfriendly, their storage and disposal after use, becomes a major problem. That problem is addressed by the present invention.

Of background interest to the present invention is U.S. Pat. No. 4,462,415 of Otzen issued Jul. 31, 1984 which describes and illustrates a parts washer basin incorporating a cleaning fluid storage tank positioned directly below the basin, and a pump to draw liquid from the tank to the basin. After use the liquid then flows by gravity to the tank.

Cokic et al Canadian Patent No. 769,838 issued Oct. 24, 1967 and U.S. Pat. No. 3,453,665 issued Jul. 8, 1969 describe and illustrate a portable toilet sink unit incorporating a basin positioned beside a fresh water holding tank. Either by means of a pump or by means of tilting the unit to allow flow of water from the tank into the basin through an orifice in a wall of the basin, the orifice communicating with the holding tank, fresh water from the tank may be placed into the basin. Once used, an outlet in the bottom of the basin discharges the water to a suitable external discharge point.

U.S. Pat. No. 4,012,798 of Liautaud issued Mar. 22, 1977 describes and illustrates a portable emergency eye wash fountain wherein a water holding chamber positioned above water outlet valves in a basin permits a directed water flow, as required, from the reservoir through the outlets to the basin. Again, from the basin, water is discharged through an outlet to an external discharge point.

OBJECT OF THE PRESENT INVENTION

It is an object of the present invention to provide a combination basin and liquid storage container which will easily and effectively permit transferring a desired amount of liquid from the container to the basin and from the basin to the container, as required.

SUMMARY OF THE INVENTION

In accordance with the present invention there is provided a recuperation basin. The basin comprises a basin section having a bottom and circumscribing walls, and an adjacent liquid storage container having walls circumscribing a central chamber. One of the walls of the basin and one of the walls of the container intermediate the two, form a common wall. An aperture is located in a common wall so as to permit passage of liquid in the container chamber into the basin chamber and to permit passage of liquid from the basin into the container chamber by tilting the recuperation basin towards the storage container.

A plug is preferably provided for the aperture, which plug has an elongated handle to extend above the liquid level in the basin container when the basin contains liquid and the plug is in position in the aperture.

In a preferred embodiment, the common wall is contoured as an elongated groove to collect liquid from the basin and channel it towards the aperture as the recuperation basin is tilted from liquid containing to upright position. As well, the aperture is positioned to one side of the groove and the groove is downwardly inclined towards the aperture when the recuperation basin is oriented in upright position. A vent doubling as a pouring channel, extends from the container chamber to an aperture in an exterior wall of the basin on a side of the groove opposite to that of the aperture in the common wall of the recuperation basin.

It will be understood that, in accordance with the present invention, a desired amount of liquid from the container may be transferred to the basin for use merely by unplugging the aperture and, if necessary, appropriately tilting the recuperation basin so that the container chamber is somewhat above the basin. Similarly, by tilting the recuperation basin so that the basin is somewhat above the container chamber, liquid from the container may be returned, through the aperture, to the container for storage.

BRIEF DESCRIPTION OF THE DRAWINGS

These and other objects and advantages of the invention will become apparent upon reading the following detailed description and upon referring to the drawings in which.

Figure 1:
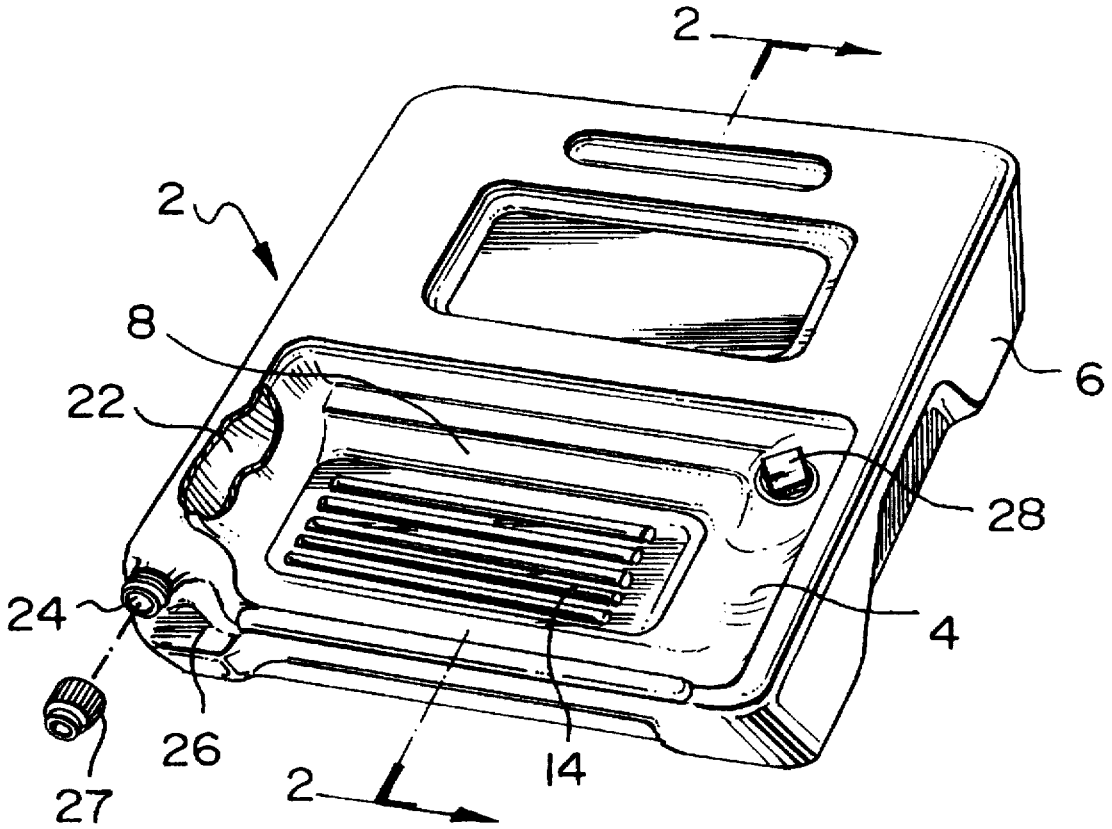
FIG 1 is a perspective view of a recuperation basin in accordance with the present invention.
Figure 2:
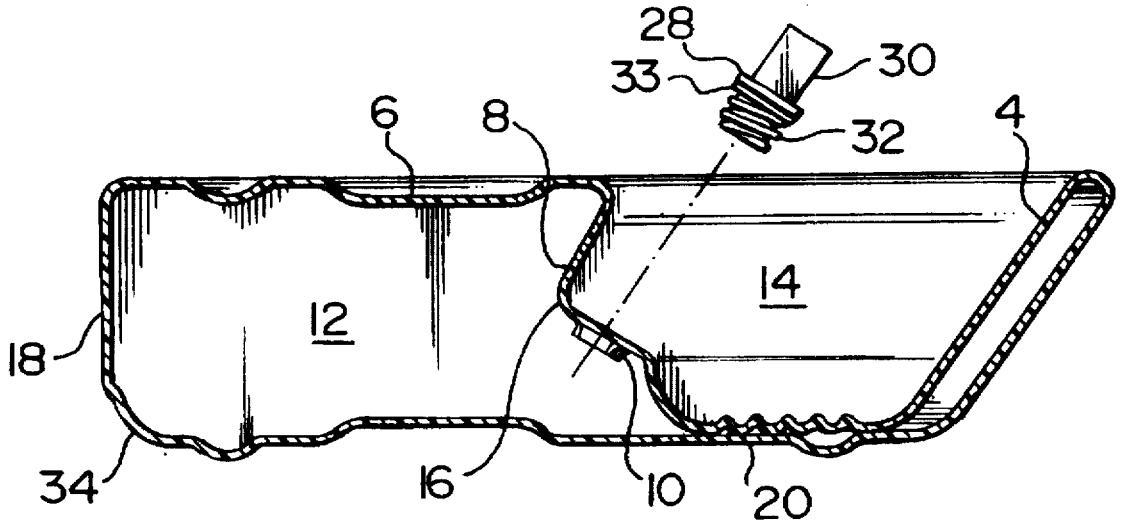
FIG. 2 is a section view of the recuperation basin along line 2—2 of FIG. 1.

While the invention will be described in conjunction with an illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Figure 3:
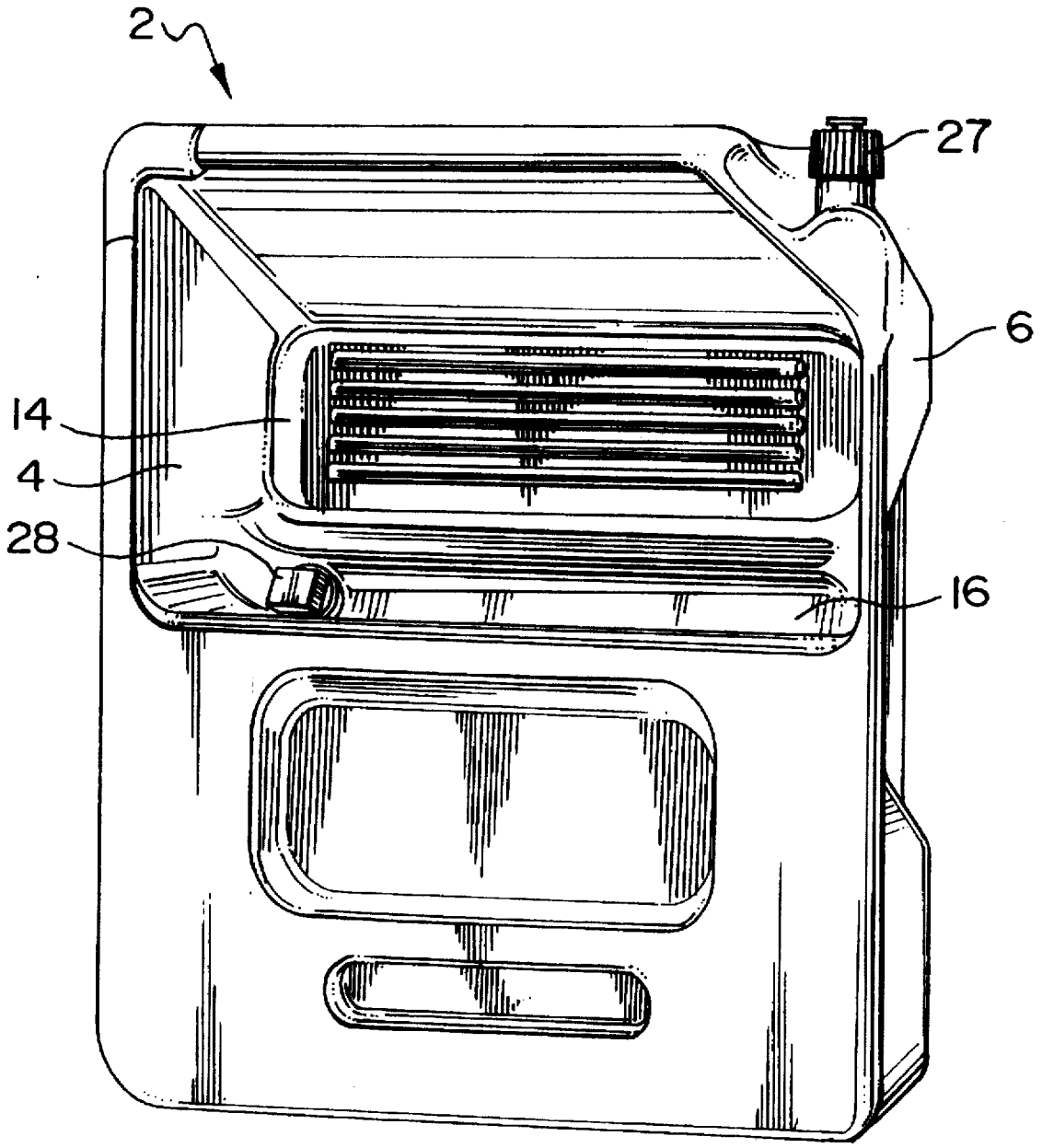
FIG. 3 is a front perpsective view of the recuperation basin of FIG. 1, in upright position.

Turning to the drawings, there is illustrated in FIG. 1 a recuperation basin 2 in accordance with the present invention, comprising a basin section 4 positioned beside a liquid storage container 6. A common wall 8, which will be described in more detail hereinafter, lies between basin section 4 and storage container 6. An aperture 10 is located in common wall 8 to permit communication between chamber 12 of container 6 and the basin 14 of basin section 4. Common wall 8 is preferably contoured as an elongated groove 16 extending along the inner side of basin 14, and preferably downwardly inclined when the container 6 is in upright position, as illustrated in FIG. 3, to channel liquid in basin 14 in a downward direction towards aperture 10. For this reason, aperture 10 is preferably located at the (lower) end of groove 16. To permit recuperation basin 2 to be supported stably in that upright position, wall 18 of container 6 is formed as a flat bottom. Similarly, to support recuperation basin in operative position so that liquid can be held in basin 14 and basin 14 used, a flat base 20, at a 90° angle to wall 18, is provided beneath basin section 4 and container 6.

Aperture 10 is preferably positioned on wall 8 so that when recuperation basin is in operative position supported on base 20, the liquid level line of liquid about half filling chamber 12 of container 6 will pass through that aperture. In this manner, liquid from a filled to half-filled chamber 12 may be passed into basin 14 without the need to tilt the recuperation basin 2 towards basin 14. Preferably basin 14 has about the same volume as, or somewhat less volume than, chamber 12).

As can be seen in FIG. 1, from chamber 12 a passageway 22, which serves as both an air vent to chamber 12 to prevent bubbling through aperture 10 when liquid is being poured through aperture 10 into basin 14 or a pouring channel when liquid is to be discharged, for example for disposal purposes, from container 6, extends from the container chamber ending in an aperture 24 in an exterior wall 26 of basin section 4. Passageway 22 and aperture 24 are located on a side of recuperation basin 2 opposite from that of aperture 10 to permit its proper functioning. An appropriate removable cap 27 closes aperture 24.

As can be seen in FIG. 1, a plug 28 for aperture 10, with an elongated handle 30, which handle is intended to extend above the liquid level in basin 14, when basin 14 is in use, is provided to prevent flow of liquid through aperture 10. Wide threads 32, which prevent the build-up of dirt or other foreign matter between the threads are provided on plug 28 for threadably engaging corresponding threads (not shown) about the periphery of aperture 10. An O-ring 33 seated beneath a shoulder of plug 28 assists in sealing aperture 10 when plug 28 is in position.

In operation, with plug 28 removed from aperture 10, vent 24 open and recuperation basin 2 on its base 20, liquid from chamber 12 of container 6 is permitted to flow through aperture 10 to a desired level in basin 14. Plug 28 is then reinserted into aperture 10 to seal that aperture and prevent further transfer of liquid between basin 14 and container chamber 12.

Once the liquid in basin 14 has been used for its intended purpose, and it is desired to return that liquid, for storage, to container 6, plug 28 is again removed from aperture 10 and, with vent 24 open, recuperation basin 2 gradually tilted about the common edge 34 formed by bottom 18 and base 20, to enable groove 16 to collect liquid from basin 14 and channel it towards aperture 10, where it then returns into chamber 12. Groove 16 minimizes spillage of liquid from basin 14 during this collection procedure. Once the liquid has been completely returned to container chamber 12, plug 28 is reinserted into aperture 10.

Both the filling of basin 14 with liquid from container 6, and returning of that liquid to container 6 are preferably carried out with cap 27 removed, to open aperture 24 and permit air flow to chamber 12 through passageway 22, thereby minimizing bubbling or other turbulence occurring at aperture 10 during these procedures.

If it is desired to empty some or all of the liquid contents of container 16, cap 27 may be removed from aperture 24 and recuperation basin 2 appropriately tilted to allow gravity flow of liquid through passageway 22 out aperture 24. Again, during this procedure, it is preferred that plug 28 be removed from aperture 10 to provide air flow into chamber 12 as liquid is allowed to flow from it through passageway 22.

Thus it is apparent that there has been provided in accordance with the invention a recuperation basin that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A recuperation basin comprising a basin section having a bottom and circumscribing walls, and an adjacent liquid storage container having walls circumscribing a central chamber, one of the walls of the basin and one of the walls of the container intermediate the two forming a common wall, an aperture located in said common wall so as to permit passage of liquid in the container chamber into the basin and to permit passage of liquid from the basin Into the container chamber by tilting the recuperation basin so the basin is somewhat above the container chamber, and wherein a container wall opposite the common wall is flat and positioned to provide a bottom to support the recuperation basin in an upright position and a side of the recuperation basin below the basin section is oriented at 90° to said bottom, to form a base to support the basin in liquid-containing position, the aperture being positioned on the common wall so that, when the recuperation basin is supported on its base bottom, the level line of liquid about half filling the chamber will pass through the aperture, and wherein the common wall is contoured as an elongated groove to collect liquid from the basin and channel it towards the aperture when the recuperation basin is oriented in upright position.

2. A recuperation basin comprising a basin section having a bottom and circumscribing walls, and an adjacent liquid storage container having walls circumscribing a central chamber, one of the walls of the basin and one of the walls of the container intermediate the two forming a common wall, an aperture located in said common wall so as to permit passage of liquid in the container chamber into the basin and to permit passage of liquid from the basin Into the container chamber by tilting the recuperation basin so the basin is somewhat above the container chamber, and wherein a container wall opposite the common wall is flat and positioned to provide a bottom to support the recuperation basin in an upright position and a side of the recuperation basin below the basin section is oriented at 90° to said bottom, to form a base to support the basin in liquid-containing position, the aperture being positioned on the common wall so that, when the recuperation basin is supported on its bottom, the level line of liquid about half filling the chamber will pass through the aperture.

3. A recuperation basin according to claim 2 in combination with a releasable plug for the aperture.

4. A recuperation basin according to claim 3 wherein the plug is provided with an elongated handle to extend above the liquid level in the basin when the plug is in position in the aperture and there is liquid in the basin.

5. A recuperation basin according to claim 4 wherein the plug and aperture have threaded confronting surfaces, the threads having a wide distance between them to minimize collection of debris between the threads.

6. A recuperation basin according to claim 5 wherein the plug is provided with a shoulder below the handle, which shoulder overhangs the aperture when the plug is in position, and an O-ring positioned immediately beneath the shoulder, about the plug, to seal the aperture against leakage of liquid when the plug is in position in the aperture.

7. A recuperation basin according to claim 2 wherein the common wall is contoured as an elongated groove to collect liquid from the basin and channel it towards the aperture when the recuperation basin Is tilted from liquid-containing to upright position.

8. A recuperation basin according to claim 7 wherein the aperture in the common wall is positioned towards one end of the groove and the groove is downwardly inclined towards the aperture when the recuperation basin is oriented in upright position.

9. A recuperation basin according to claim 7 further provided with a vent doubling as a pouring channel, extending from the container chamber to an aperture in an exterior wall of the basin on a side of the groove opposite to that of the aperture in the common wall of the recuperation basin.

10. A recuperation basin according to claim 2 wherein the volume of the container chamber to that of the basin is approximately 1:1.

* * * * *